US007854566B2

(12) United States Patent
Hall et al.

(10) Patent No.: US 7,854,566 B2
(45) Date of Patent: Dec. 21, 2010

(54) NOZZLES INCORPORATED INTO A MILLING MACHINE

(76) Inventors: David R. Hall, 2185 S. Larsen Pkwy., Provo, UT (US) 84606; David Wahlquist, 2185 S. Larsen Pkwy., Provo, UT (US) 84606; Neil Cannon, 2185 S. Larsen Pkwy., Provo, UT (US) 84606; Thomas Morris, 2185 S. Larsen Pkwy., Provo, UT (US) 84606

( * ) Notice: Subject to any disclaimer, the term of this patent is extended or adjusted under 35 U.S.C. 154(b) by 301 days.

(21) Appl. No.: 12/145,409

(22) Filed: Jun. 24, 2008

(65) Prior Publication Data

US 2008/0267706 A1 Oct. 30, 2008

Related U.S. Application Data

(63) Continuation-in-part of application No. 11/566,151, filed on Dec. 1, 2006, now Pat. No. 7,458,645, and a continuation-in-part of application No. 11/668,390, filed on Jan. 29, 2007, now Pat. No. 7,507,053, and a continuation-in-part of application No. 11/644,466, filed on Dec. 21, 2006, now Pat. No. 7,596,975.

(51) Int. Cl.
*E01C 23/088* (2006.01)

(52) U.S. Cl. ..... 404/111; 404/84.05; 404/93; 404/94; 404/95

(58) Field of Classification Search ..... 404/111, 404/90–95, 115, 118, 84.05
See application file for complete search history.

(56) References Cited

U.S. PATENT DOCUMENTS

| | | | | | |
|---|---|---|---|---|---|
| 4,139,318 | A | | 2/1979 | Jakob | |
| 4,473,320 | A | * | 9/1984 | Register | 404/91 |
| 4,561,145 | A | * | 12/1985 | Latham | 15/346 |
| 4,793,730 | A | | 12/1988 | Butch | |
| 4,827,559 | A | | 5/1989 | Norland | |
| 4,971,476 | A | * | 11/1990 | Guillon | 404/91 |
| 5,078,540 | A | | 1/1992 | Jakob | |
| 5,505,598 | A | | 4/1996 | Murray | |
| 5,544,971 | A | * | 8/1996 | Huege et al. | 404/72 |
| 5,794,854 | A | | 8/1998 | Yie | |
| 6,149,342 | A | * | 11/2000 | Phillips | 404/90 |
| 6,179,519 | B1 | * | 1/2001 | Hilmersson | 404/91 |
| 6,733,086 | B1 | | 5/2004 | McSharry | |
| 7,004,675 | B2 | * | 2/2006 | Wayne | 404/91 |
| 2001/0022919 | A1 | * | 9/2001 | Bruns et al. | 404/91 |

* cited by examiner

*Primary Examiner*—Raymond W Addie
(74) *Attorney, Agent, or Firm*—Tyson J. Wilde; Philip W. Townsend, III

(57) ABSTRACT

In one aspect of the invention, a system for removing a layer of a paved surface comprises a vehicle adapted to traverse a paved surface in a selected direction. The vehicle also comprises a milling drum with an axle connected to the vehicle, the drum being adapted to rotate around the axle substantially normal the selected direction. A moldboard is positioned rearward of the milling drum and also connected to the vehicle. A plurality of nozzles is disposed proximate a bottom end of the moldboard and is in communication with a fluid reservoir through a fluid pathway and the plurality of nozzles is adapted to move independent of the moldboard.

20 Claims, 13 Drawing Sheets

NOZZLES INCORPORATED INTO A MILLING MACHINE

CROSS REFERENCE TO RELATED APPLICATIONS

This application is a continuation in-part of U.S. patent application Ser. Nos. 11/566,151 filed Dec. 1, 2006 now U.S. Pat. No. 7,458,645; 11/668,390; filed Jan. 29, 2007 now U.S. Pat. No. 7,507,053; and 11/644,466 filed Dec. 21, 2006 now U.S. Pat. No. 7,596,975 which are all herein incorporated by reference for all that they disclose.

BACKGROUND OF THE INVENTION

The present invention relates to milling machines that are used in road surface repairs. Milling machines are typically utilized to remove a layer or layers of old or defective road surface in preparation for resurfacing. Typically the milling machines direct milled road fragments towards a conveyer which takes the fragments off the road, however, a significant amount of debris, aggregate, and fragments remain on the milled surface. When resurfacing a milled surface, it is desirable that it is substantially clean of any residue material. Failure to clear the milled surface may result in poor bonding between the new asphalt and the milled surface.

U.S. Pat. No. 4,139,318 by Jakob et al., which is herein incorporated by reference for all that it contains, discloses a method and apparatus for planning a paved roadway wherein a main frame is drivingly supported by track assemblies and a planer assembly is disposed in cutting engagement with a top portion of the pave roadway to produce a new roadway surface.

U.S. Pat. No. 4,793,730 by Butch, which is herein incorporated by reference for all that it contains, discloses a method and apparatus for renewing the surface of asphaltic paving at low cost and for immediate reuse.

U.S. Pat. No. 5,505,598 by Murray, which is herein incorporated by reference for all that it contains, discloses a modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine.

U.S. Pat. No. 6,733,086 by McSharry et al., which is herein incorporated by reference for all that it contains, discloses a vacuum system mounted on a portable milling machine for extracting material cut by the milling drum of the machine from the surface of a roadway.

BRIEF SUMMARY OF THE INVENTION

In one aspect of the invention, a system for removing a layer of a paved surface comprises a vehicle adapted to traverse a paved surface in a selected direction. The vehicle also comprises a milling drum with an axle connected to the vehicle, the drum being adapted to rotate around the axle substantially normal the selected direction. A moldboard is positioned rearward of the milling drum and also connected to the vehicle. A plurality of nozzles is disposed proximate a bottom end of the moldboard and is in communication with a fluid reservoir through a fluid pathway and the plurality of nozzles is adapted to move independent of the moldboard.

The plurality of nozzles may be attached to a moveable element in mechanical communication with the moldboard. The moveable element may be adapted to displace vertically.

The moveable element may comprise an end pivotally attached to the moldboard. The moveable element may be adapted to be positioned manually. The moveable element may be hydraulically driven. The moveable element may comprise at least one linkage. A securing mechanism may be adapted to hold the moveable element in a non-operating position. The securing mechanism may comprise a latch and strike assembly. The securing mechanism may comprise at least one magnet. The moveable element may be in electrical communication with a processing element adapted to position the moveable element. The moveable element may comprise a wear plate. The moveable element may be adapted to move along a guide track. A release mechanism may be incorporated into the moldboard and adapted to release the nozzles from the vehicle. The moveable element may incorporate a portion of the moldboard. The moveable element may be in mechanical communication with a motor. The moveable element may comprise at least one operating position determined by a stop incorporated on the moldboard. The vehicle may comprise a feedback control adapted to modify at least one parameter of the nozzles. The parameter may be an angle at which the nozzles eject a fluid. The parameter may be a fluid pressure.

DETAILED DESCRIPTION OF THE INVENTION AND THE PREFERRED EMBODIMENT

Figure 1:
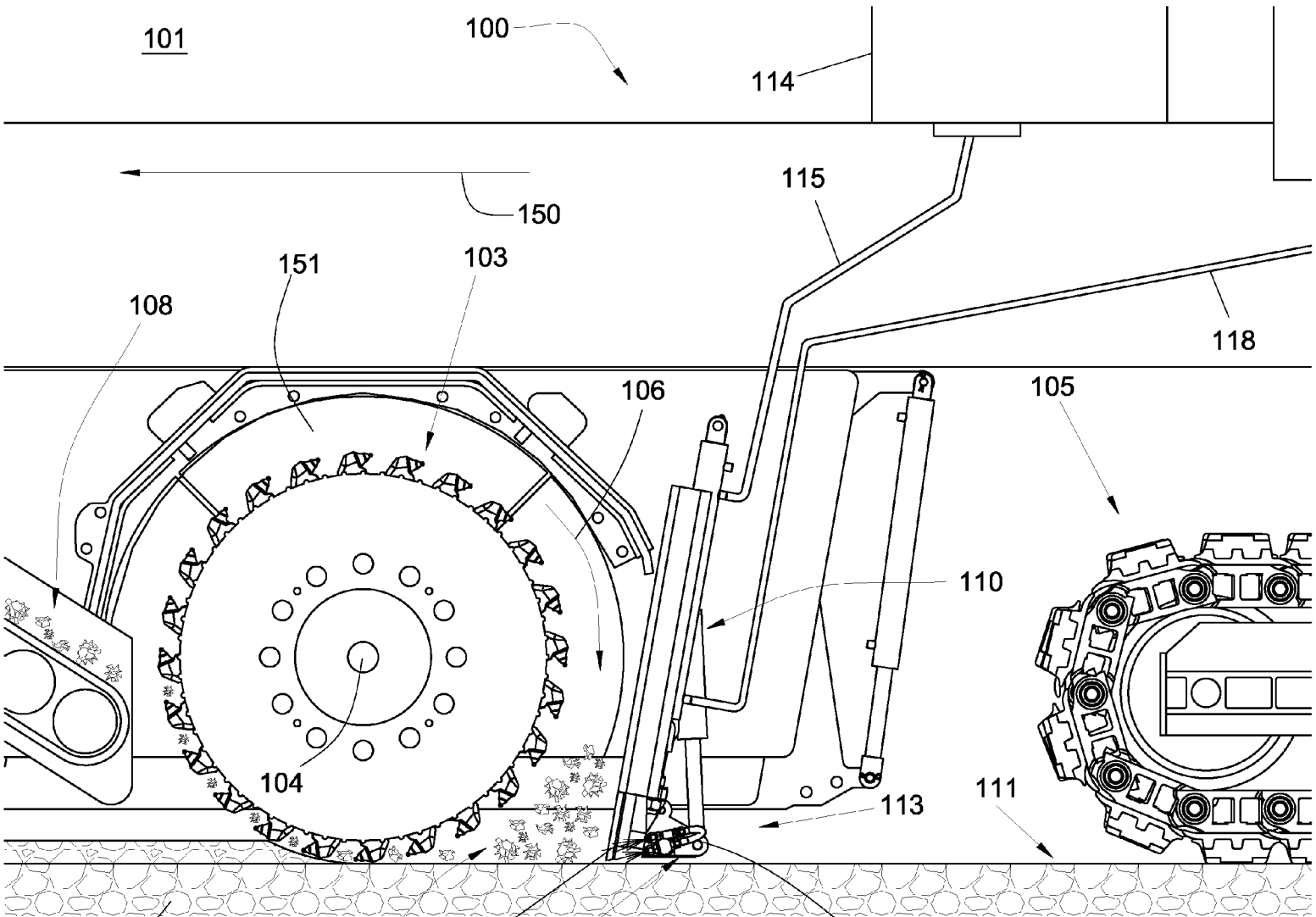
FIG. 1 shows a cross sectional diagram of an embodiment of a trenching machine.

Referring now to FIG. 1, an embodiment of the current invention, specifically a system 100 for removing a layer of paved surface is shown. The system 100 may comprise a vehicle 101 adapted to traverse a paved surface 111 in a selected direction depicted by arrow 150 with a milling drum 103 comprising an axle 104 connected to the vehicle 101. In the current embodiment the vehicle 101 comprises tracks, but in other embodiments rubber wheels or translation mechanisms may be utilized. The milling drum 103 may also be adapted to rotate around the axle 104 substantially normal to the selected direction. The milling drum 103 may be disposed in the milling chamber 151. In some embodiments the milling drum 103 may be rotated in a clockwise direction, depicted by arrow 106, by a means which may include an internal combustion engine (not shown). A conveyer belt 108 may be positioned adjacent the milling drum 103 and adapted to remove a portion of the loose aggregate 109. The loose aggregate 109 may then be deposited into a collecting vehicle (not shown) that may follow in front, rear or side of the milling machine 101.

A moldboard 110 is connected to the vehicle 101 and is positioned rearward of the milling drum 103. The moldboard 110 may push any residual loose aggregate or debris along the milled surface, although some loose aggregate typically escapes from the milling chamber through a gap between the bottom of the moldboard and the milled surface. A plurality of nozzles 112 may be disposed proximate the end 113 of the moldboard 110 and be in communication with a fluid reservoir 114 through a fluid pathway 115. The end 113 may comprise a leading edge 116 that is adapted to engage the loose aggregate and/or debris. The end 113 may also comprise a rear portion 117 disposed generally rearward the leading edge. An exhaust system 118 may run adjacent to the fluid path 115 such that the heat from the exhaust may be used to heat the fluid in the fluid path 115. The plurality of nozzles 112 may be disposed rearward of the moldboard 110 and adapted to direct fluid underneath the moldboard 110 through the gap and towards the milling drum 103.

The fluid may comprise hot fluid, steam, cold fluid, water, polymers, synthetic clay, surfactants, binding agents, or combinations thereof depending on the type of application that the system 100 is being engaged in. In some embodiments the kinetic energy resulting from the fluid being ejected from the nozzles 112 may push aggregate towards the milling drum 103 and prevent any loose aggregate 109 from escaping under the moldboard 110. In other embodiments the chemical composition of the fluid may be used to provide a substantially cleaner milled surface 111 for repaving. In some embodiments the fluid from the nozzles 112 suppress dust created by the milling process. The fluid from the nozzles 112 may also provide the benefits of reducing friction, absorbing heat, and dissolving aggregate 109.

Figure 2:
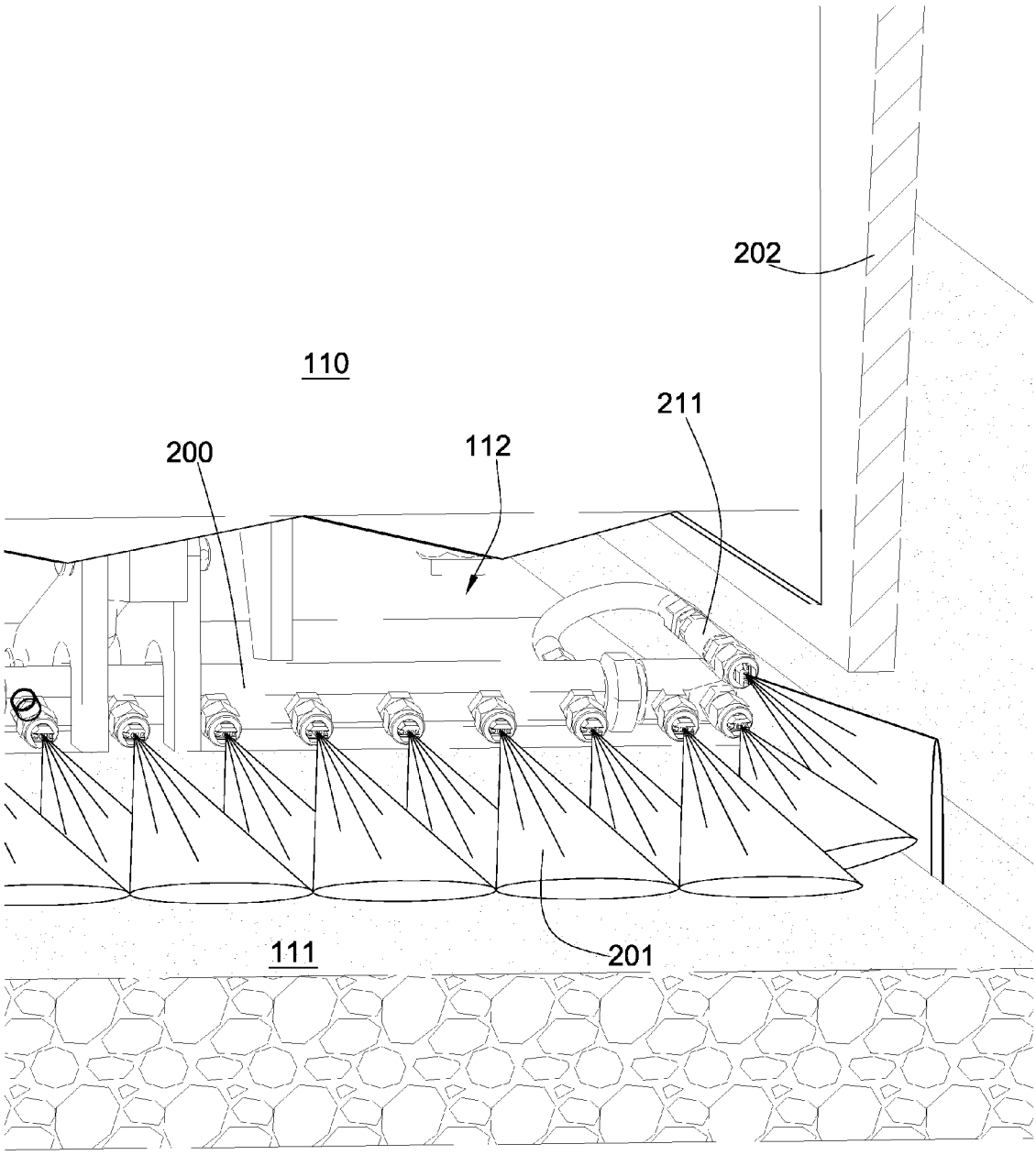
FIG. 2 shows a perspective diagram of an embodiment of a plurality of nozzles.

Now referring to FIG. 2, a plurality of nozzles 112 is shown attached to a moveable element 200 attached to the moldboard. The plurality of nozzles 112 may be adapted to direct a liquid 201 toward the loose aggregate. The moveable element 200 may be pivotally attached to the moldboard 110 and adapted to be moved to an operating position and non-operating position. In some embodiments, the plurality of nozzles 112 may be aligned in a substantially straight pattern. A nozzle 211 may also be placed in the corner formed by the moldboard 110 and a side wall 202.

Figure 3:
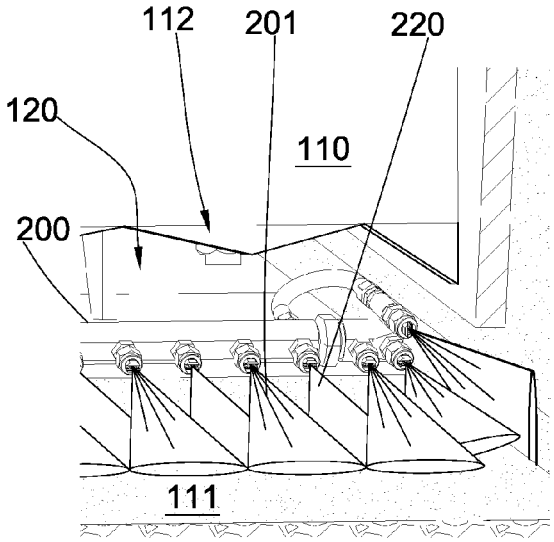
FIG. 3 shows a perspective diagram of another embodiment of a plurality of nozzles.

FIG. 3 shows an embodiment of a plurality of nozzles 112 adapted to direct a liquid 201 towards a milled surface 111. In some embodiments, a portion of the plurality of nozzles 120 may overlap with the nozzle coverage of another portion of the plurality. The portions of the plurality may be angled differently or positioned at different heights.

In some embodiments, a gas, such as ambient air may be incorporated into a portion of the nozzles to dry the milled surface after the water has been dispersed or while the water is being dispersed. In some embodiments, the nozzles eject a gas instead of a liquid to direct the bose aggregate towards the milling drum. In some embodiments, the air may be heated to help evaporate the moisture on the milled surface. The moisture may also be removed by directing the gas towards a spot where the moisture tends to accumulate.

Figure 4:
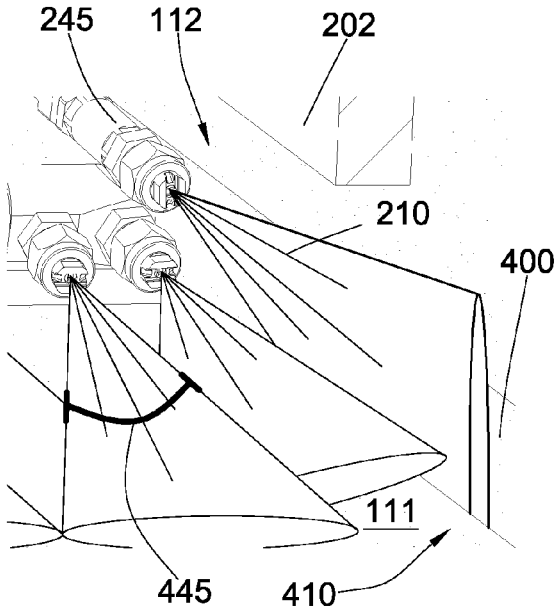
FIG. 4 shows a perspective diagram of another embodiment of a plurality of nozzles.

FIG. 4 shows a perspective view of an embodiment of a plurality of nozzles 112. At least one nozzle 245 of the plurality of nozzles 112 may be disposed in a corner created by the moldboard (shown in FIG. 3) and a side wall 202 of the milling chamber. The bottom of the side wall may or may not ride along an uncut portion 400 of the paved surface 111. The at least one nozzle 245 may direct a liquid 210 towards the top of the uncut portion 400 and/or a wall formed by the depth of cut. The corner 410 may be cleaned by the at least one nozzle 245 and the plurality of nozzles 112. At least one of the nozzles may comprise a fan angle 455 of 15 to 60 degrees or more specifically, 23 degrees to 27 degrees. The liquid 210 may be pressurized to 100 to 10,000 pounds per square inch. More specifically, the liquid pressure may be 4,000 to 5,000 pounds per square inch. The liquid jet may be oriented at a 3 to 60 degree angle with respect to the milled surface 111, or more specifically, 10 to 15 degrees.

Figure 5:
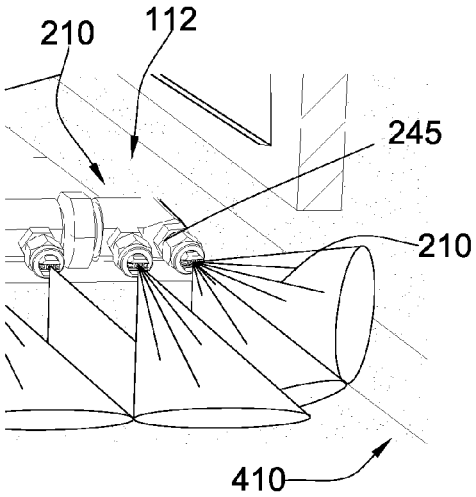
FIG. 5 shows a perspective diagram of another embodiment of a plurality of nozzles.

FIG. 5 shows a perspective view of an embodiment of a plurality of nozzles 112. At least one nozzle 245 of the plurality of nozzles 112 may be adapted to direct a liquid 210 towards both the wall formed by the depth of cut and the milled surface. The at least one nozzle 245 may comprise a v-shape.

Figure 6:
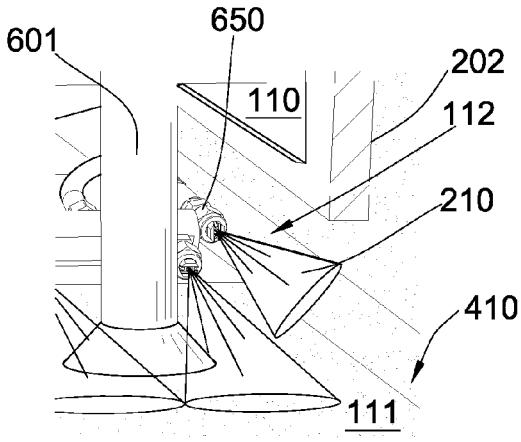
FIG. 6 shows a perspective diagram of another embodiment of a plurality of nozzles.

FIG. 6 shows a perspective diagram of an embodiment of a plurality of nozzles 112. A suction device 601 may be attached to the vehicle for removing moisture and/or the loose aggregate. The suction device 601 may be disposed in the corner where cleaning may be more difficult.

Figure 7:
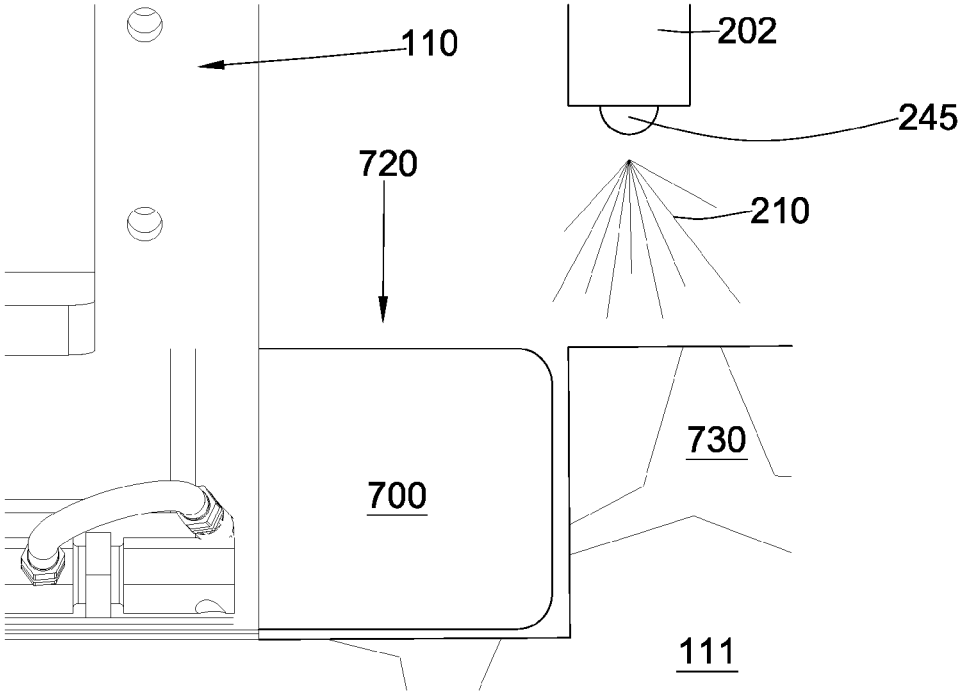
FIG. 7 shows a perspective diagram of another embodiment of a portion of a milling machine.

FIG. 7 shows a perspective view of an embodiment of a spacer 700 attached to a moldboard 110 to fill a gap 720 may be formed between the moldboard 110 and a wall formed by the depth of cut. The spacer may block loose aggregate from espacing through the gap 720. The side wall 202 may comprise at least one nozzle 245 adapted to clean the uncut portion 730 of the paved surface 111 by directing a liquid 210 towards the uncut portion.

Figure 8:
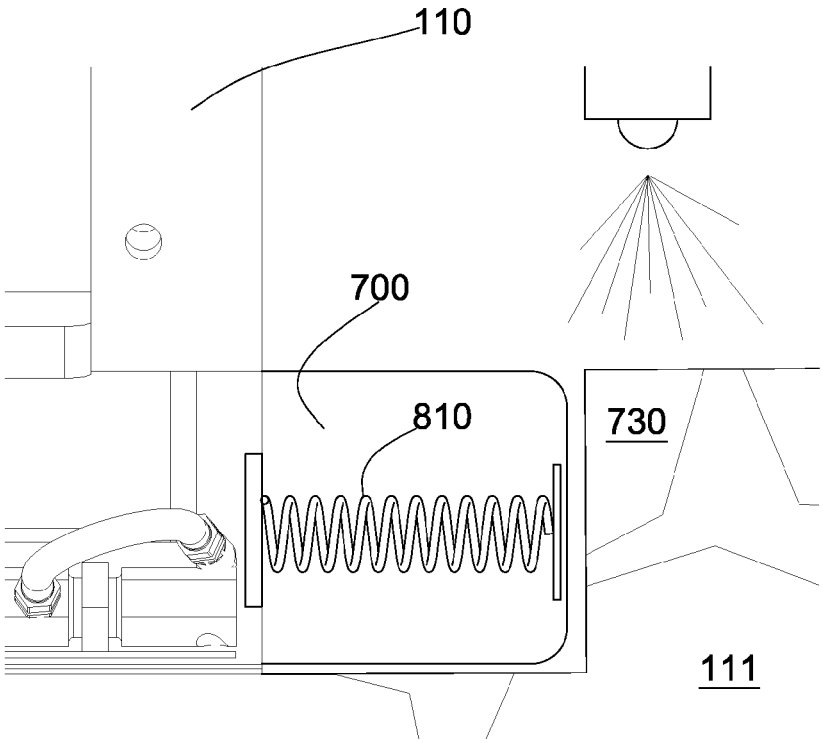
FIG. 8 shows a perspective diagram of another embodiment of a portion of a milling machine.

FIG. 8 shows a perspective diagram of an embodiment of a spring-loaded spacer 700 attached to a moldboard 110. A spring-loaded spacer may provide the benefit of allowing the space to follow a nonuniform wall formed by the depth of cut and allow some flexibility if the milling machine turns.

Figure 9:
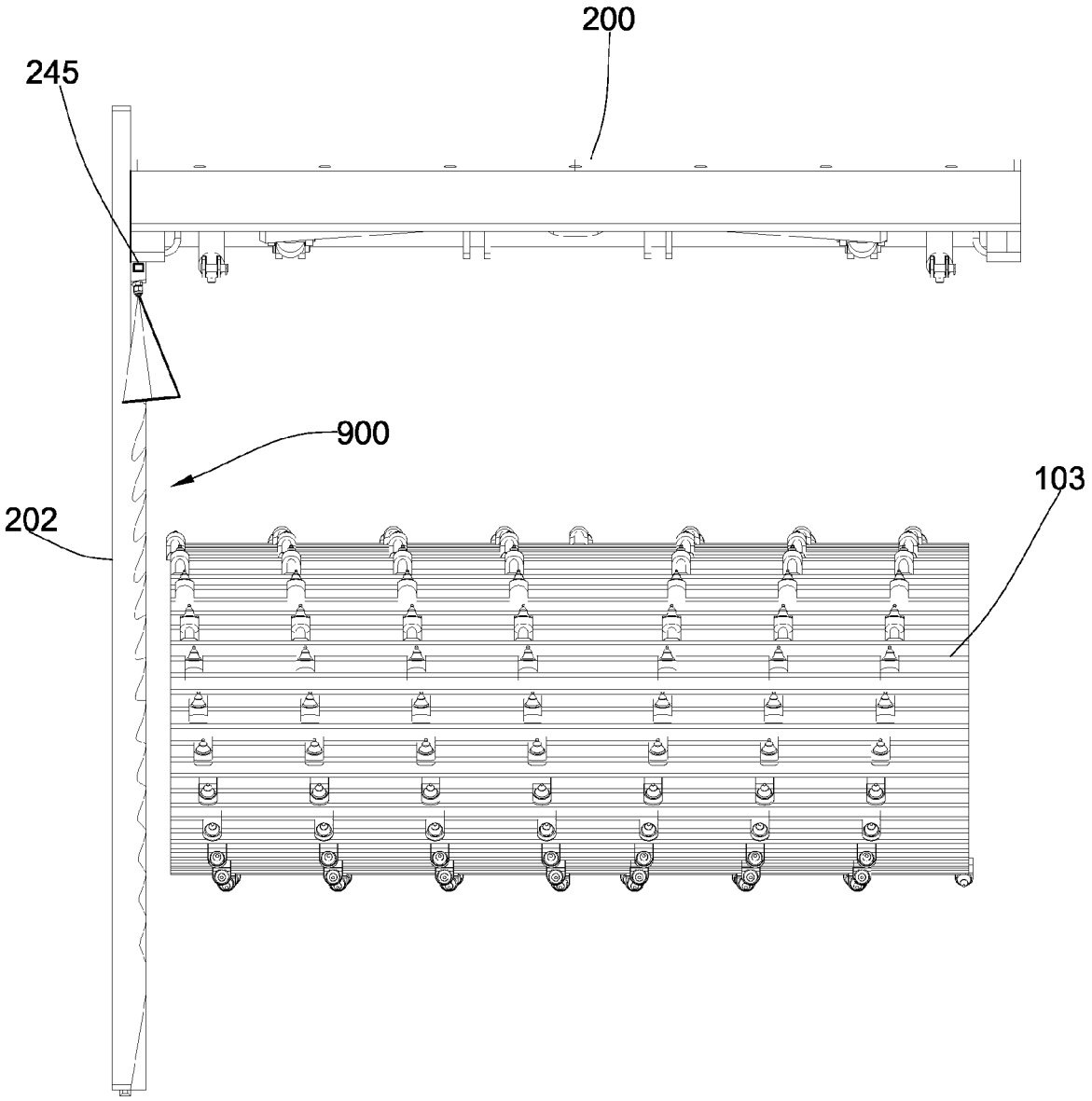
FIG. 9 shows a bottom diagram of an embodiment of a portion of a milling machine.

FIG. 9 shows a bottom view of an underside of a milling machine. A side wall 202 of the milling chamber may also be proximate the milling drum 103. The side wall 202 may comprise a geometry 900 adapted to move aggregate off of the uncut portion of the paved surface. The geometry may be a scalloped shape, a biased shape, an angled shape, and/or a curved shape.

Figure 10:
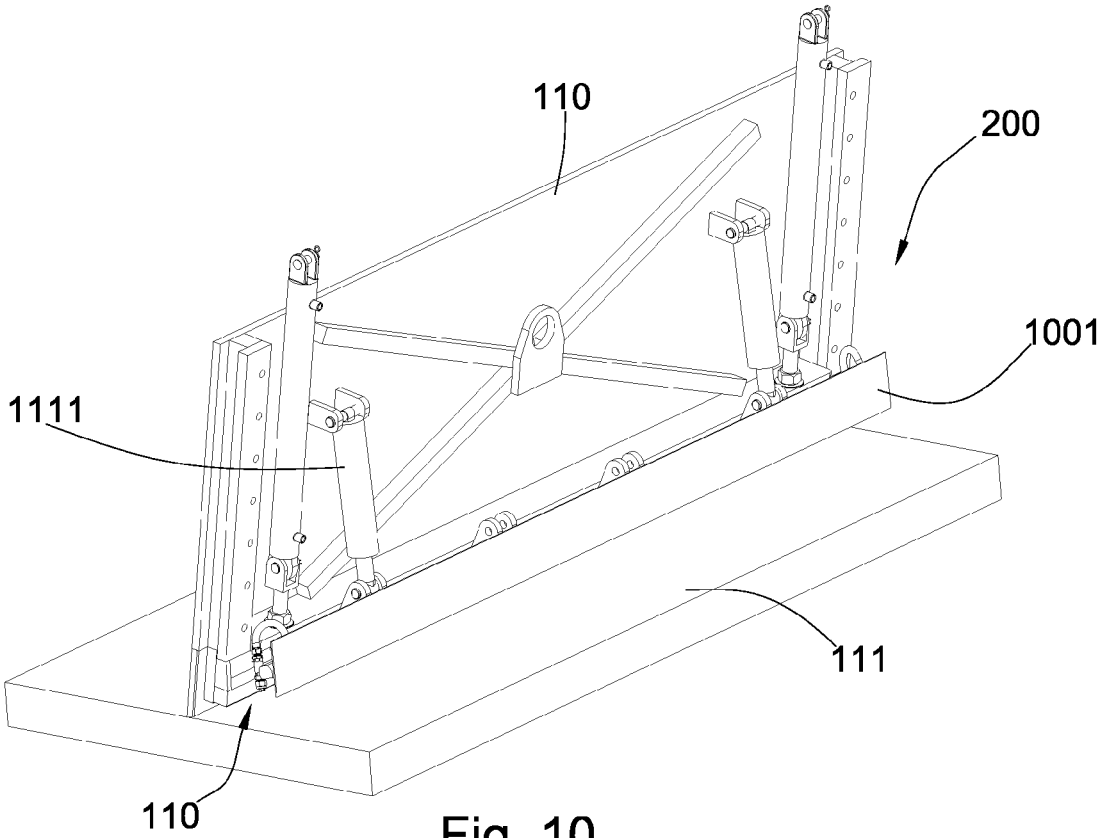
FIG. 10 shows a perspective diagram of an embodiment of a moldboard.

Now referencing FIG. 10, a perspective diagram of a moldboard 110 is shown. The moldboard 110 may comprise a moveable element 200 with a plurality of nozzles 112. In the embodiment of FIG. 10, the moveable element is in a non-operating position. The moveable element 200 may also comprise a wear plate 1001. The moveable element 200 may pivot using hydraulics 1111 as shown in this embodiment or it may be moved manually.

Figure 11:
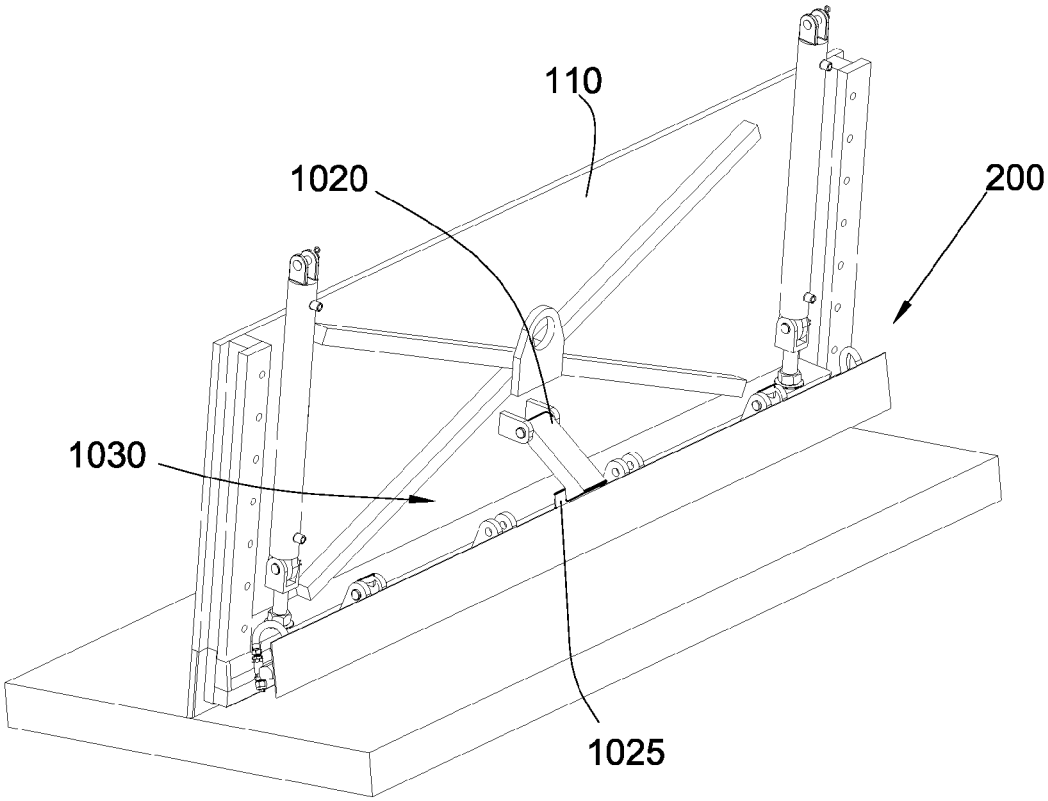
FIG. 11 shows a perspective diagram of another embodiment of a moldboard.

FIG. 11 shows a perspective diagram of an embodiment of a moldboard 110. A moveable element 200 may be pivotally attached to the moldboard 110. The moveable element 200 may be secured to the moldboard 110 through a securing mechanism 1030. In some embodiments, the securing mechanism 1030 may be a latch 1020 and strike 1025.

Figure 12:
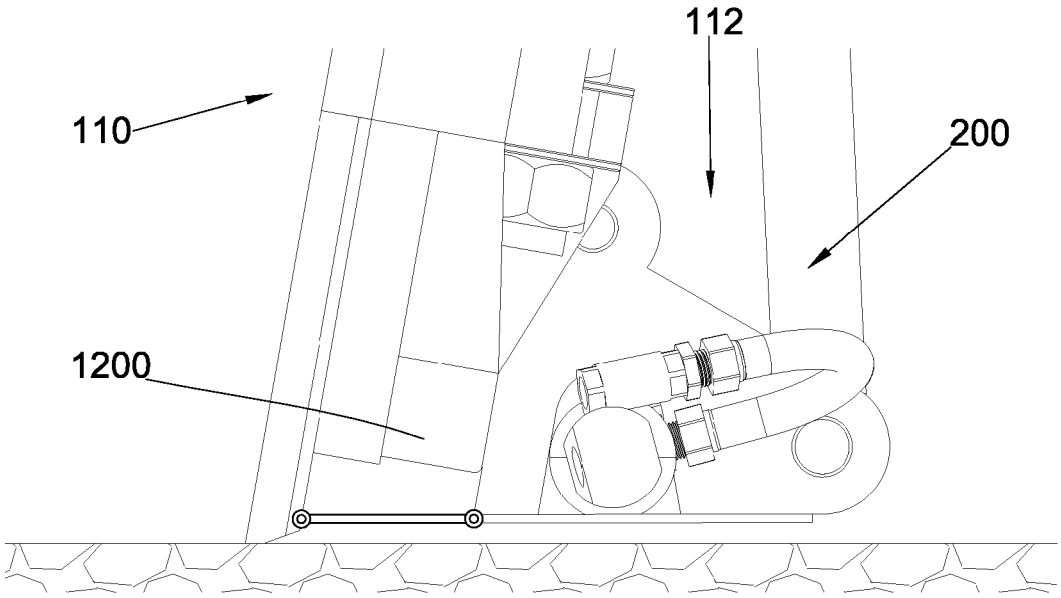
FIG. 12 shows a perspective diagram of an embodiment of a moveable element.

FIG. 12 shows a perspective diagram of a moveable element 200 on a moldboard 110. The moveable element 200 may be pivotally attached to the moldboard 110 and/or vertically adjustable. The correct operational position may be ensured each time by including a stop 1200 on the base end of the moldboard 110.

Figure 13:
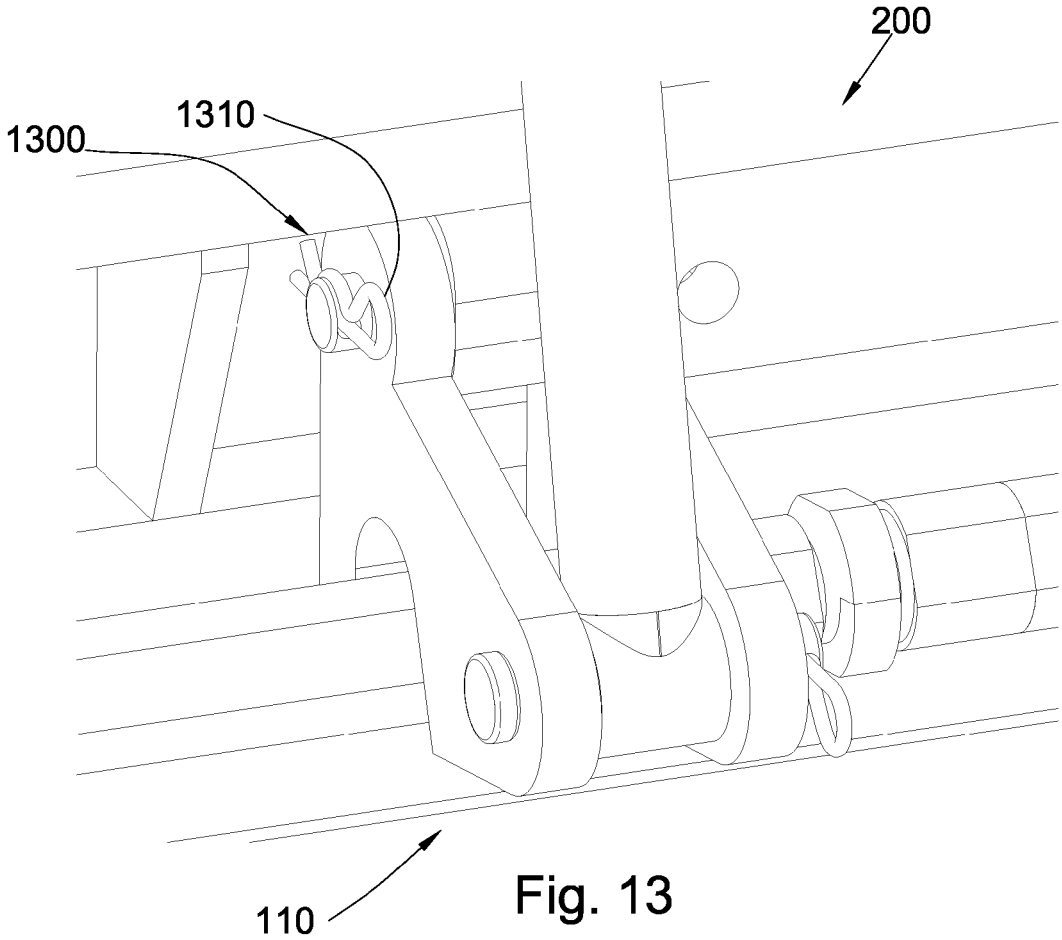
FIG. 13 shows a perspective diagram of another embodiment of a moveable element.

FIG. 13 shows a perspective diagram of an embodiment of a release mechanism 1300. The moveable element 200 may comprise a release mechanism 1300 adapted to enable an operator to move the movable element without much effort. In this embodiment, a pin 1310 may secure the moveable element 200 to the moldboard 110.

Figure 14:
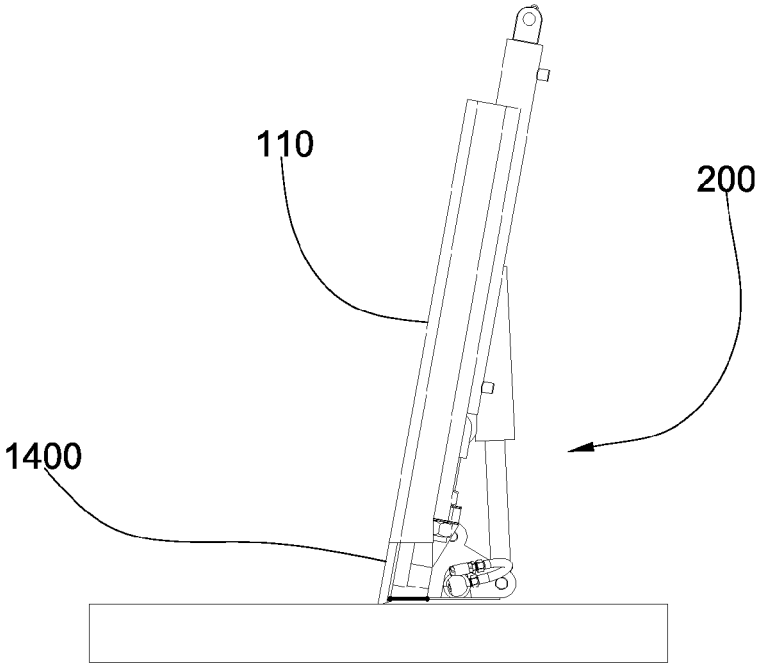
FIG. 14 shows a side view of an embodiment of a moldboard.
Figure 15:
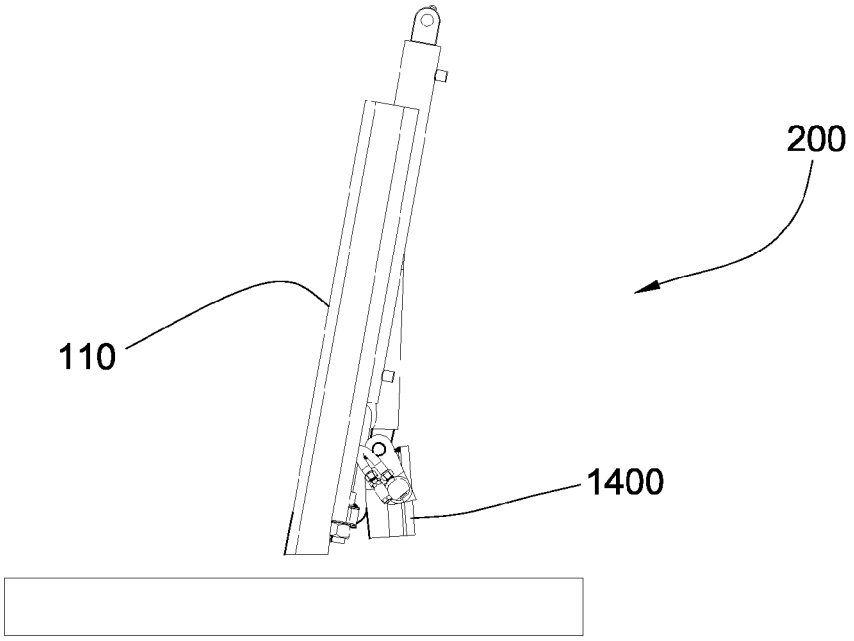
FIG. 15 shows a side view of another embodiment of a moldboard.

FIG. 14 shows a side view of an embodiment of a moldboard 110. In some embodiments, the moveable element 200 may comprise a portion of the moldboard 1400. In operating position, the moveable element 200 may incorporate a portion of the moldboard 110. FIG. 15 shows a side view of an embodiment of a moldboard 110 in a non-operating position.

Figure 16:
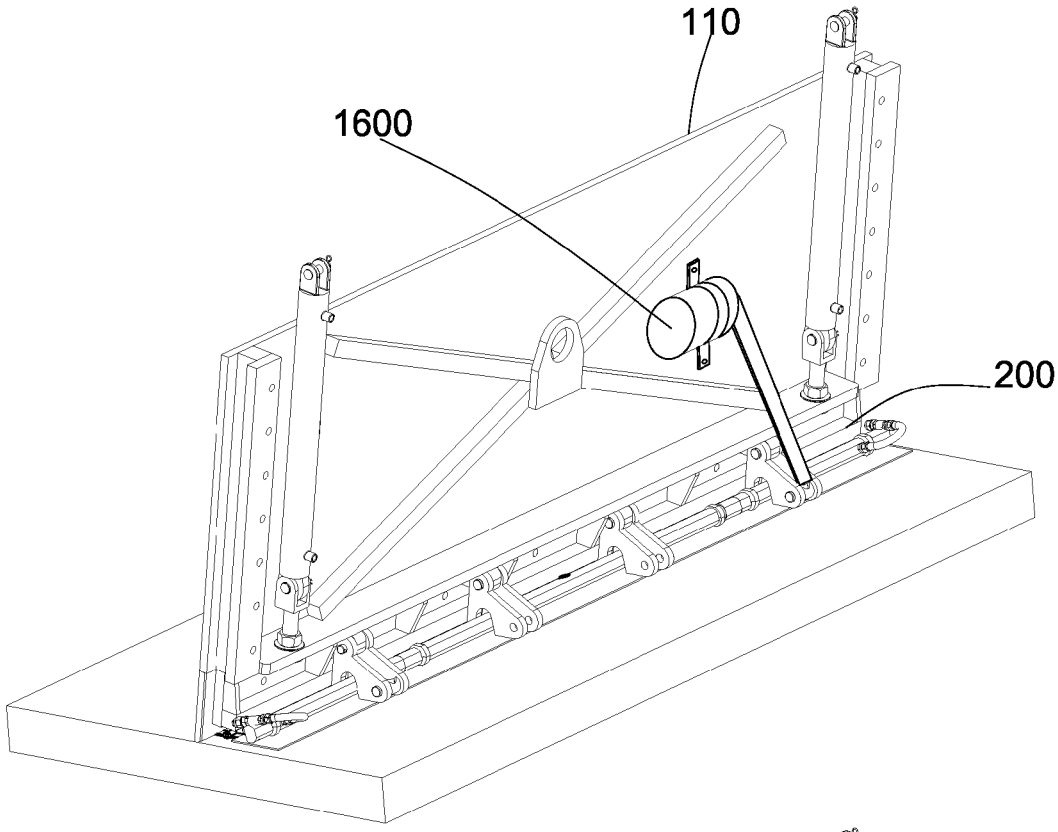
FIG. 16 shows a perspective diagram of another embodiment of a moldboard.

FIG. 16 shows a perspective view of another embodiment of a moldboard 110. The moveable element 200 may be moved from an operating to non-operating position using a motor 1600.

Figure 17:
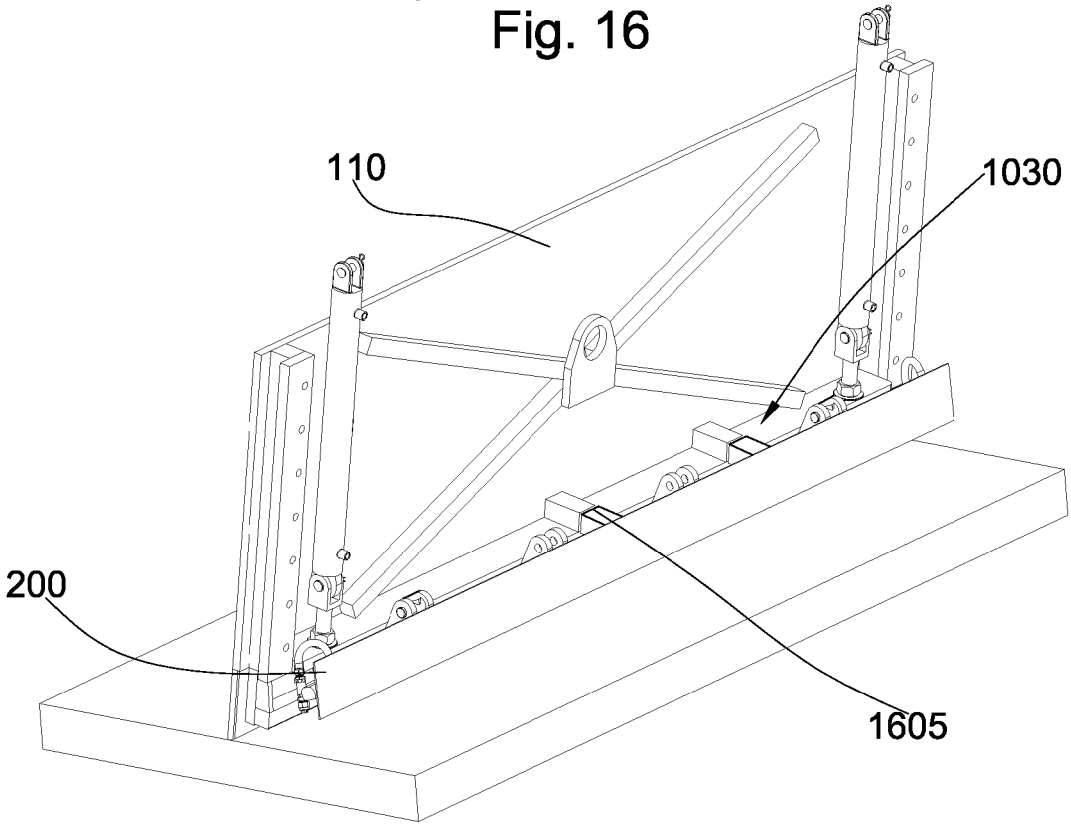
FIG. 17 shows a perspective diagram of another embodiment of a moldboard.

FIG. 17 shows a perspective view of another embodiment of a moldboard 110. In this embodiment, the securing mechanism 1030 is a pair of magnets 1605.

Figure 18:
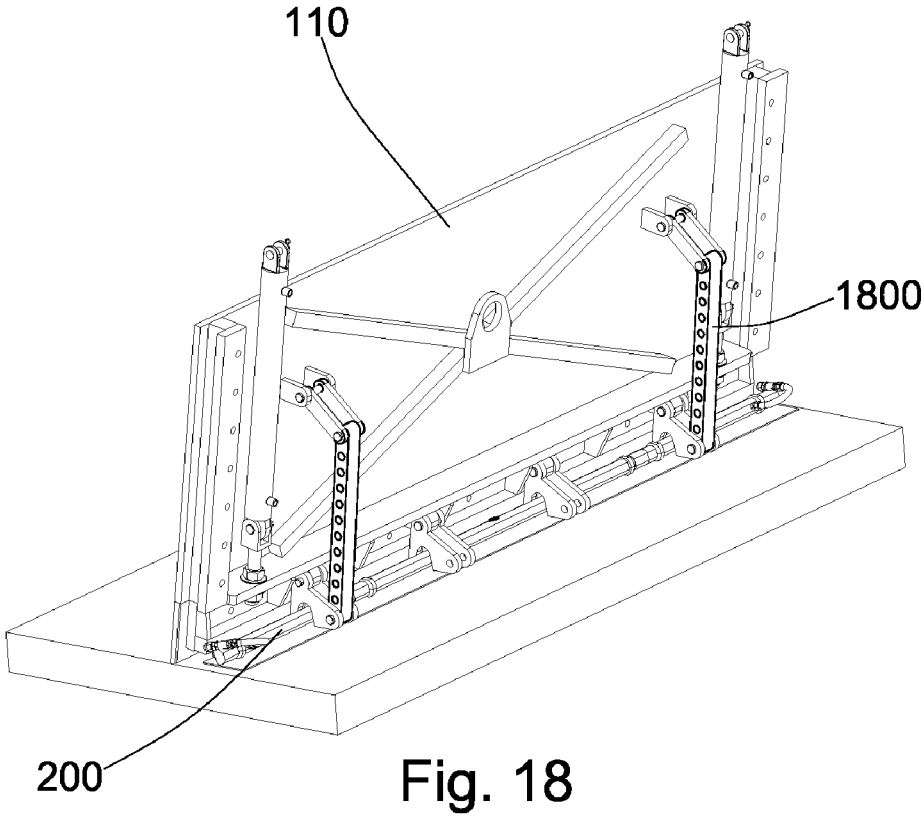
FIG. 18 shows a perspective diagram of another embodiment of a moldboard.

FIG. 18 shows a perspective view of another embodiment of a moldboard 110. The moveable element 200 may be pivotally attached to the moldboard 110 through a linkage 1800.

Figure 19:
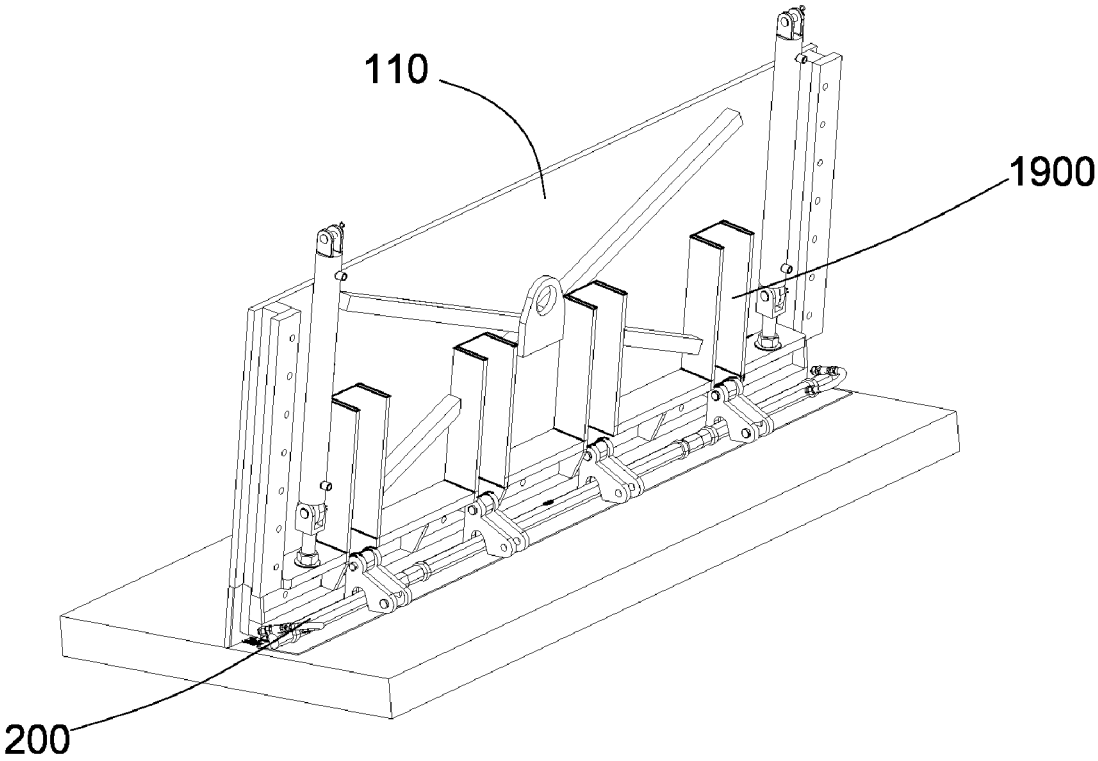
FIG. 19 shows a perspective diagram of another embodiment of a moldboard.

FIG. 19 shows a perspective diagram of another embodiment of a moldboard 110. The moveable element 200 may be vertically translatable through a guide track 1900 incorporated into the moldboard 110.

Figure 20:
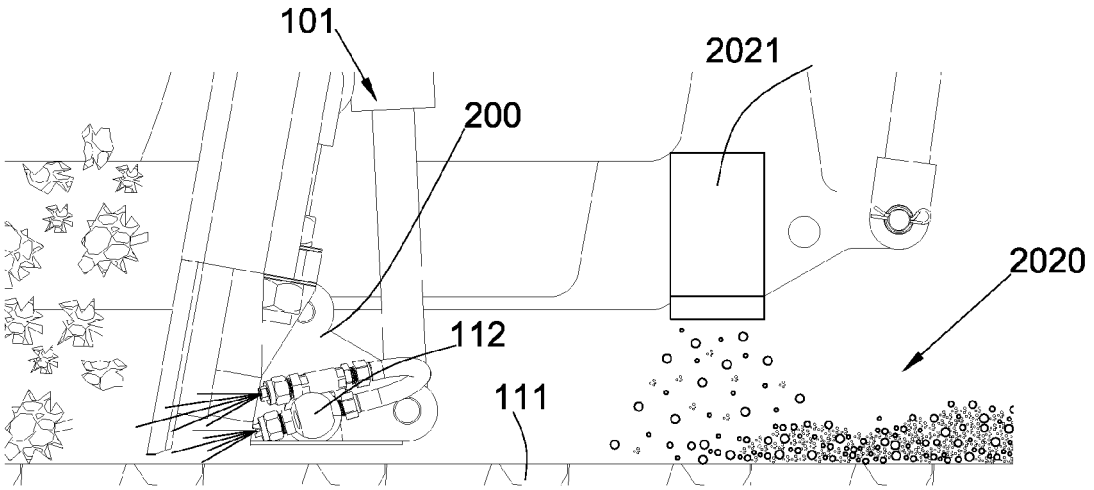
FIG. 20 shows a perspective diagram of another embodiment of a portion of a milling machine with a dispenser.

FIG. 20 discloses a substance dispenser 2021 that may be disposed behind the moveable element 200 and deposits a liquid absorbent 2020 on the milled surface 111. The liquid absorbent 2020 may absorb residual moisture left behind by the plurality of nozzles. It is believed that the water absorbent may be easier to remove than the residual moisture. The liquid absorbent 2020 may function to substantially dry the milled surface 111. In some embodiments, the dispenser may deposit a tact coat or other agent that may be useful in for repaving.

In some embodiments, the nozzles are fixed to a rigid portion of the moldboard and are not incorporated in a moveable element. A built-in manifold adapted to direct fluid to the nozzles may comprise ports formed directly into the moldboard.

Figure 21:
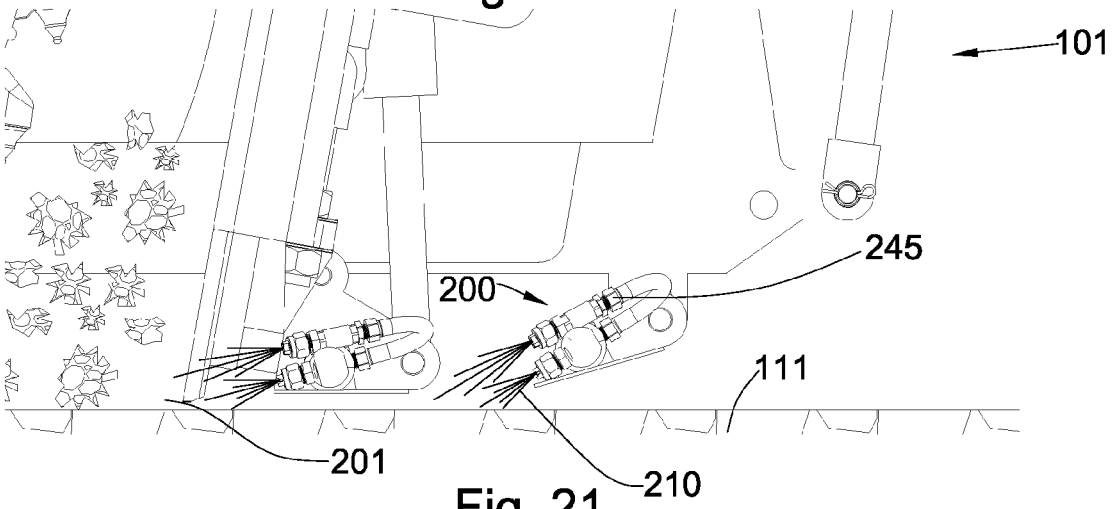
FIG. 21 shows a perspective diagram of another embodiment of a portion of a milling machine with nozzle attachment.

FIG. 21 discloses at least one nozzle 245 behind the moveable element 200 and adapted to direct a fluid 210 to the milled surface in a direction with the direction of the plurality of nozzles. The fluid 210 may act to forcibly remove liquid 201 from the milled surface 111. In some embodiments, the fluid is a gas such as pressurized air. In some embodiments, the fluid is direct in the opposite direction as the fluid emitted from the plurality of nozzles.

Figure 22:
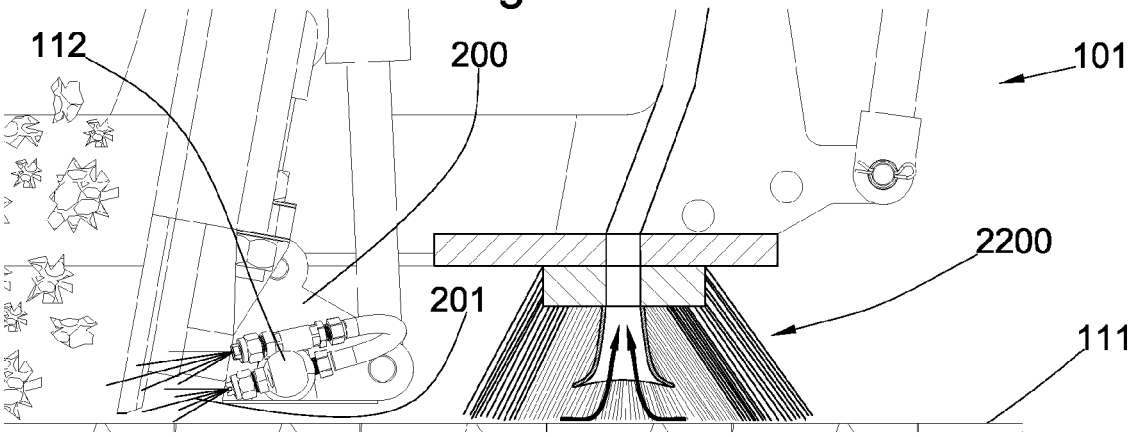
FIG. 22 shows a perspective diagram of another embodiment of a portion of a milling machine with vacuum brush attachment.

FIG. 22 discloses a vacuum brush assembly 2200 which may be behind the plurality of nozzles and adapted to collect a residual liquid 201 deposited on the road. The brush may direct the liquid into a vacuum or the brush may be disposed within the center of a rotary brush as depicted in FIG. 22.

Figure 23:
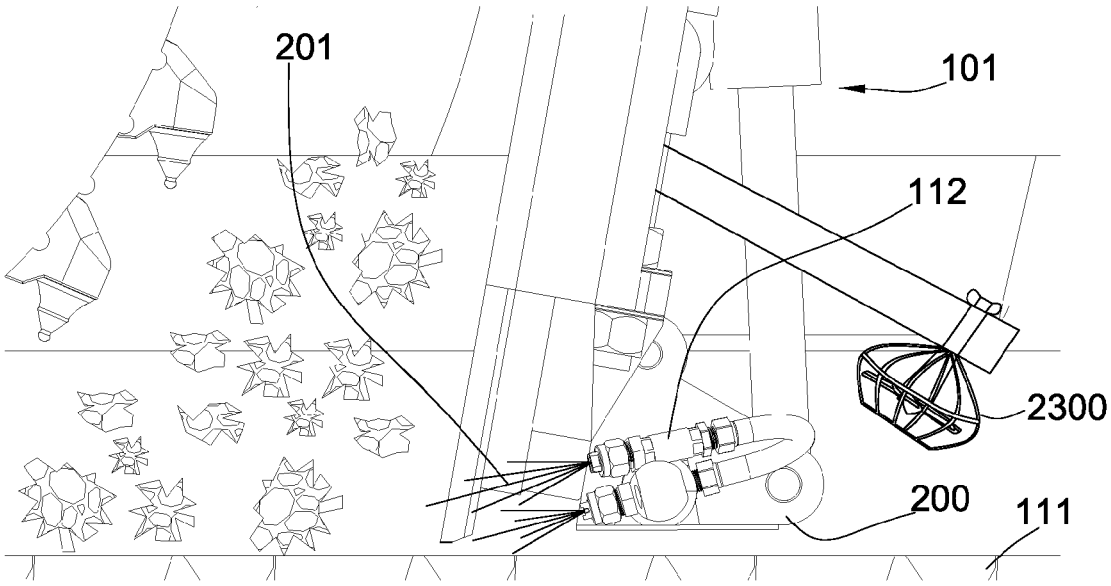
FIG. 23 shows a perspective diagram of another embodiment of a portion of a milling machine with fan attachment.

FIG. 23 discloses a fan 2300 behind the plurality of nozzles. The fan 2300 may be adapted to evaporate or otherwise remove the residual liquid 201 from the milled surface 111. The fan 2300 may direct air toward the milled surface 111 from multiple angles. The fan 2300 may also incorporate a heater and direct heated air to the milled surface 111.

Figure 24:
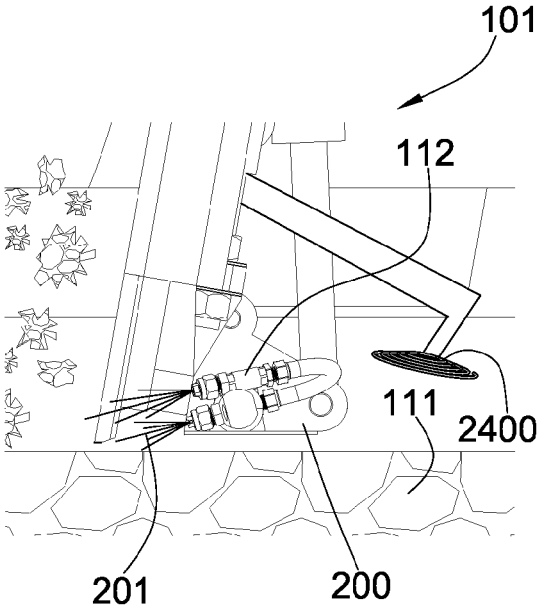
FIG. 24 shows a perspective diagram of another embodiment of a portion of a milling machine with heating element.

FIG. 24 shows a heating element 2400 behind the nozzles. The heating element 2400 may be adapted to dry or otherwise remove liquid 201 deposited by the plurality of nozzles 112 from the milled surface 111. The heating element 2400 may be adjusted to be directed toward the milled surface 111 from multiple angles.

Figure 25:
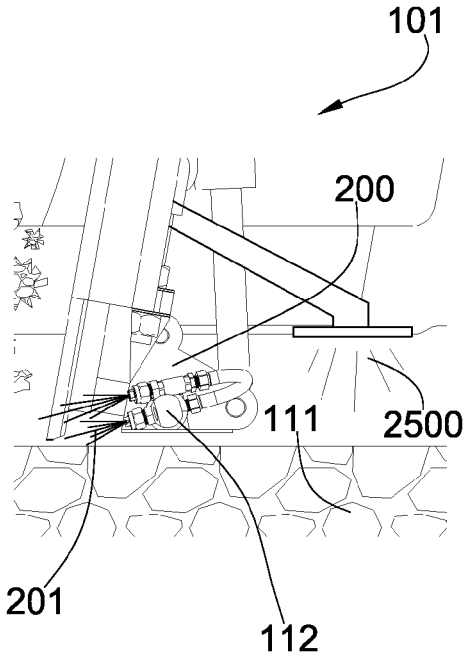
FIG. 25 shows a perspective diagram of another embodiment of a portion of a milling machine with microwave element.

FIG. 25 shows a microwave element 2500 behind the nozzles adapted to dry the milled surface. The microwave element 2500 may be adjusted to be directed toward the milled surface 111 from multiple angles. In some embodiments, there may be a microwave reflector adapted to concentrate the microwaves towards the milled surface.

Figure 26:
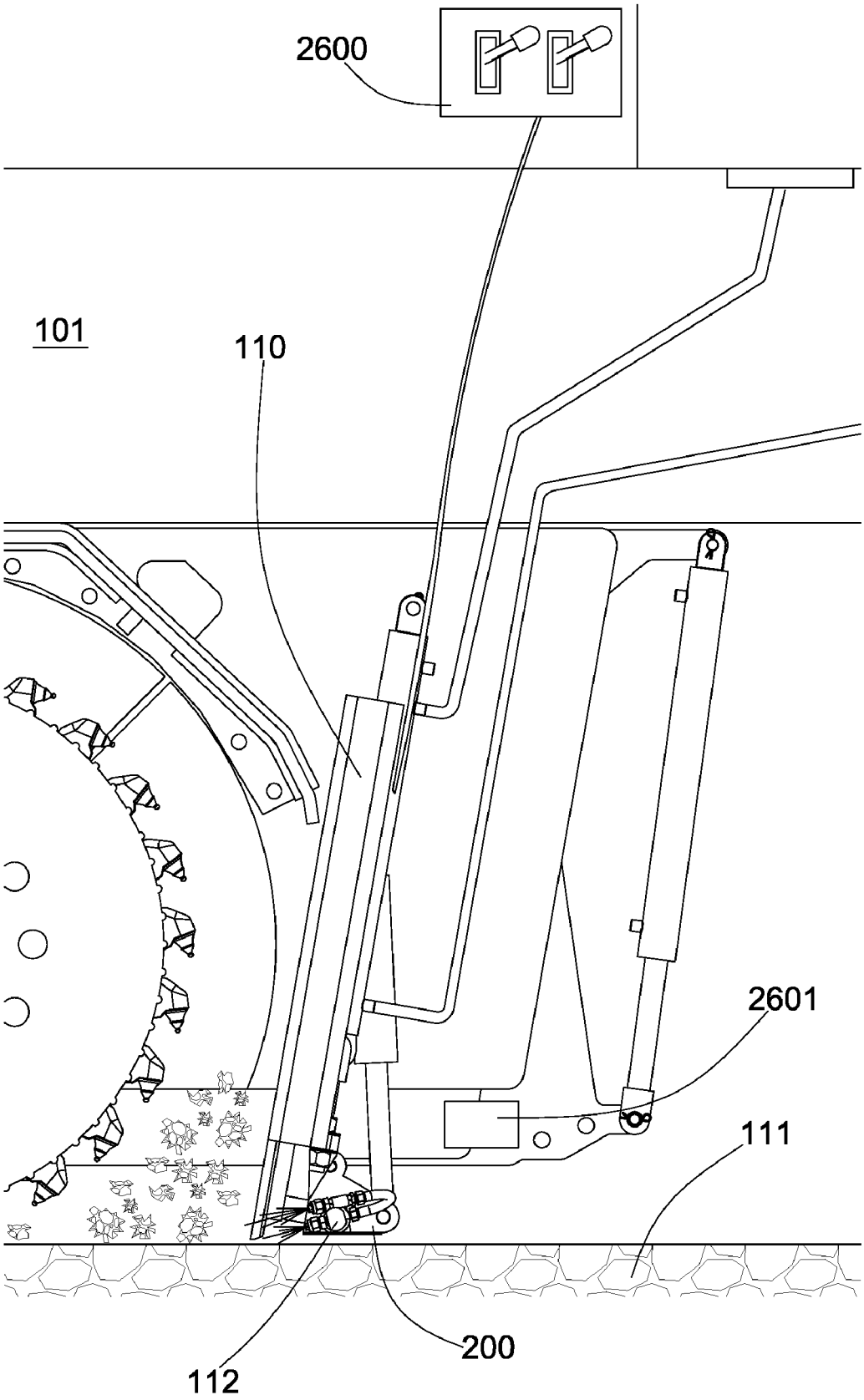
FIG. 26 shows a perspective diagram of another embodiment of a portion of a milling machine with processing unit.

FIG. 26 shows a perspective diagram of an embodiment of a portion of a milling machine 101. A processing unit 2600 may be adapted to adjust parameters of the moveable element 200, the moldboard, the plurality of nozzles, a manifold supporting the nozzles, individual nozzles or auxiliaries supporting the moldboard or the plurality of nozzles. The parameters may include the nozzle angle, water pressure, moldboard and/or nozzle height, discharge pattern, or fan angles, heater temperature, water temperature or combinations thereof. The milling machine 101 may comprise a moisture sensor 2601 adapted to calculate the moisture percentage of the milled surface 111. The moisture sensor 2601 may be in electrical communication with the processing unit 2600 which may in turn adjust the parameters. In some embodiments, a weather sensor may also be incorporated in the machine. On cold days the liquid ejected from the nozzles may be heated to help evaporation which may not be needed on hot days and that energy may be saved.

Whereas the present invention has been described in particular relation to the drawings attached hereto, it should be understood that other and further modifications apart from those shown or suggested herein, may be made within the scope and spirit of the present invention.

What is claimed is:

1. A system for removing a layer of a paved surface, comprising:

a vehicle adapted to traverse a paved surface in a selected direction;

a milling drum with an axle connected to the vehicle, the drum being adapted to rotate around the axle substantially normal the selected direction;

a moldboard positioned reward of the milling drum and also connected to the vehicle;

a plurality of nozzles is disposed proximate a bottom end of the moldboard and is in communication with a fluid reservoir through a fluid pathway;

and the plurality of nozzles adapted to move independent of the moldboard; whereby ejecting a fluid from the plurality of nozzles provides at least one of: providing a substantially cleaner milled surface, or reducing friction, or absorbing heat, or dissolving aggregate.

2. The system of claim 1, wherein the plurality of nozzles is attached to a moveable element in mechanical communication with the moldboard.

3. The system of claim 2, wherein the moveable element is adapted to displace vertically.

4. The system of claim 2, wherein the moveable element comprising an end pivotally attached to the moldboard.

5. The system of claim 2, wherein the moveable element is adapted to be positioned manually.

6. The system of claim 2, wherein the moveable element is hydraulically driven.

7. The system of claim 2, wherein the moveable element comprises at least one linkage.

8. The system of claim 2, wherein a securing mechanism is adapted to hold the moveable element in a non-operating position.

9. The system of claim 7, wherein the securing mechanism comprises a latch and strike assembly.

10. The system of claim 2, wherein the moveable element is in electrical communication with a processing element adapted to position the moveable element.

11. The system of claim 2, wherein the moveable element comprises a wear plate.

12. The system of claim 2, wherein the moveable element is adapted to move along a guide track.

13. The system of claim 2, wherein a release mechanism is incorporated into the moldboard and is adapted to release the nozzles from the vehicle.

14. The system of claim 2, wherein the moveable element incorporates a portion of the moldboard.

15. The system of claim 2, wherein the moveable element is in mechanical communication with a motor.

16. The system of claim 2, wherein the moveable element comprises at least one operating position determined by a stop incorporated on the moldboard.

17. The system of claim 2, wherein the vehicle comprises a feedback control adapted to modify at least one parameter of the nozzles.

18. The system of claim 17, wherein the parameter is an angle.

19. The system of claim 17, wherein the parameter is a fluid pressure.

20. The system of claim 2, wherein at least one of the plurality of nozzles directs a fluid in the selected direction.

* * * * *